United States Patent [19]

Gryctko

[11] 4,104,601

[45] Aug. 1, 1978

[54] DIRECT FAULT TRIPPING OF CIRCUIT BREAKER HAVING SOLID STATE TRIP MEANS

[75] Inventor: Carl E. Gryctko, Bellefontaine, Ohio

[73] Assignee: I-T-E Imperial Corp., Spring House, Pa.

[21] Appl. No.: 675,970

[22] Filed: Apr. 12, 1976

[51] Int. Cl.[2] ..... H01H 71/24; H01H 73/00

[52] U.S. Cl. ..... 335/6; 335/38; 335/174

[58] Field of Search ..... 335/16, 18, 6, 38, 174, 335/170, 229; 317/58, 33 R, 33 SC, 36 TD

[56] References Cited

U.S. PATENT DOCUMENTS

| | | | |
|---|---|---|---|
| 3,761,778 | 9/1973 | Willard | 317/33 R |
| 3,783,423 | 1/1974 | Mater et al. | 335/174 |
| 3,826,951 | 7/1974 | Mater et al. | 317/335 C |

*Primary Examiner*—Harold Broome

*Attorney, Agent, or Firm*—Ostrolenk, Faber, Gerb & Soffen

[57] ABSTRACT

A molded case multi-pole circuit breaker is provided with a solid state trip unit constructed to automatically open the breaker responsive to predetermined fault current conditions by actuating a permanent magnet latch. The latch and main conductors of the circuit breaker are constructed and arranged so that at very high short circuit currents, even if the solid state circuitry malfunctions, flux generated directly by current flow in the main conductors will buck the permanent magnet flux sufficiently to actuate the magnetic latch directly.

4 Claims, 5 Drawing Figures

DIRECT FAULT TRIPPING OF CIRCUIT BREAKER HAVING SOLID STATE TRIP MEANS

This invention relates to molded case multi-pole circuit breakers in general and more particularly relates to breakers of this type having solid state trip units for actuating a permanent magnet latch.

In order for a circuit breaker to provide maximum protection for a given load without tripping falsely, its tripping characteristics must be tailored to withstandability of the load against damage due to overheating and electro-magnetic effects. This is particularly important for a multi-pole molded case circuit breaker having a relatively high continuous current carrying capacity, say in excess of 800 amps.

It has been known for some time that trip units utilizing solid state circuitry are more readily adjusted over a wider range of characteristics than are conventional magnetic trip units. In addition, solid state trip units achieve greater accuracy and repeatability, and with relatively simple adjustments obtain more complex time versus current characteristics. One such solid state trip unit is disclosed in the G. Gaskill co-pending application Ser. No. 671,077, filed Mar. 29, 1976, and assigned to the assigness of the instant invention, as well as on other applications referred to in said application Ser. No. 671,077. In particular, the solid state trip unit of the aforesaid application, Ser. No. 671,077, actuates a permanent magnet latch upon the occurrence of predetermined fault current conditions in the circuit breaker. When this latch is released spring stored energy in the latch actuates the circuit breaker trip mechanism for opening of the circuit breaker contacts.

In accordance with the instant invention, under short circuit or very severe fault current conditions leakage flux generated by current flowing in the main conductors of the circuit breaker acts directly in opposition to the permanent magnet flux to release the permanent magnet latch even before the signal processing circuits of the solid state trip unit generate a signal for tripping the permanent magnet latch. This increase in tripping speed facilitates circuit interruption. Further, in the event the solid state trip unit malfunctions the direct action of the main current generated flux will cause tripping of the circuit breaker under very severe fault current conditions.

In order to prevent flux generated by current flow in the main conductors from interfering with operation of the solid state tripping circuit it is necessary to provide the permanent magnet latch with a degree of shielding and/or it is necessary to orient the holding flux generated by the permanent magnet at right angles to the flux generated by current in the main circuit conductors. Ideally, this right angle orientation would prevent interaction between these fluxes. However, in a practical structure not all of these fluxes are at right angles to one another. Thus, in accordance with the instant invention this interaction between flux fields which may be troublesome is controlled and utilized to produce a beneficial effect.

In a three pole circuit breaker it appears that flux generated by current in the center pole has the greatest effect upon direct tripping of the permanent magnet latch. In order to have currents in the outer poles exert a greater influence for direct tripping, elements of high magnetic permeability are strategically located to direct flux from the main conductors to the vicinity of the permanent magnet latch.

Accordingly, a primary object of the instant invention is to provide a novel construction for a multi-pole circuit breaker having a solid state automatic trip means.

Another object is to provide a circuit breaker of this type in which flux generated by current flow in the main conductors of the circuit breaker is used for direct tripping of the circuit breaker under predetermined severe fault current conditions.

Still another object is to provide a circuit breaker of this type in which a permanent magnet latch utilized as a tripping device is, under severe fault current conditions, unlatched directly by flux generated by current flowing in the main circuit conductors of the breaker.

These objects as well as other objects of this invention shall become readily apparent after reading the following description of the accompanuing drawings in which.

Figure 1:
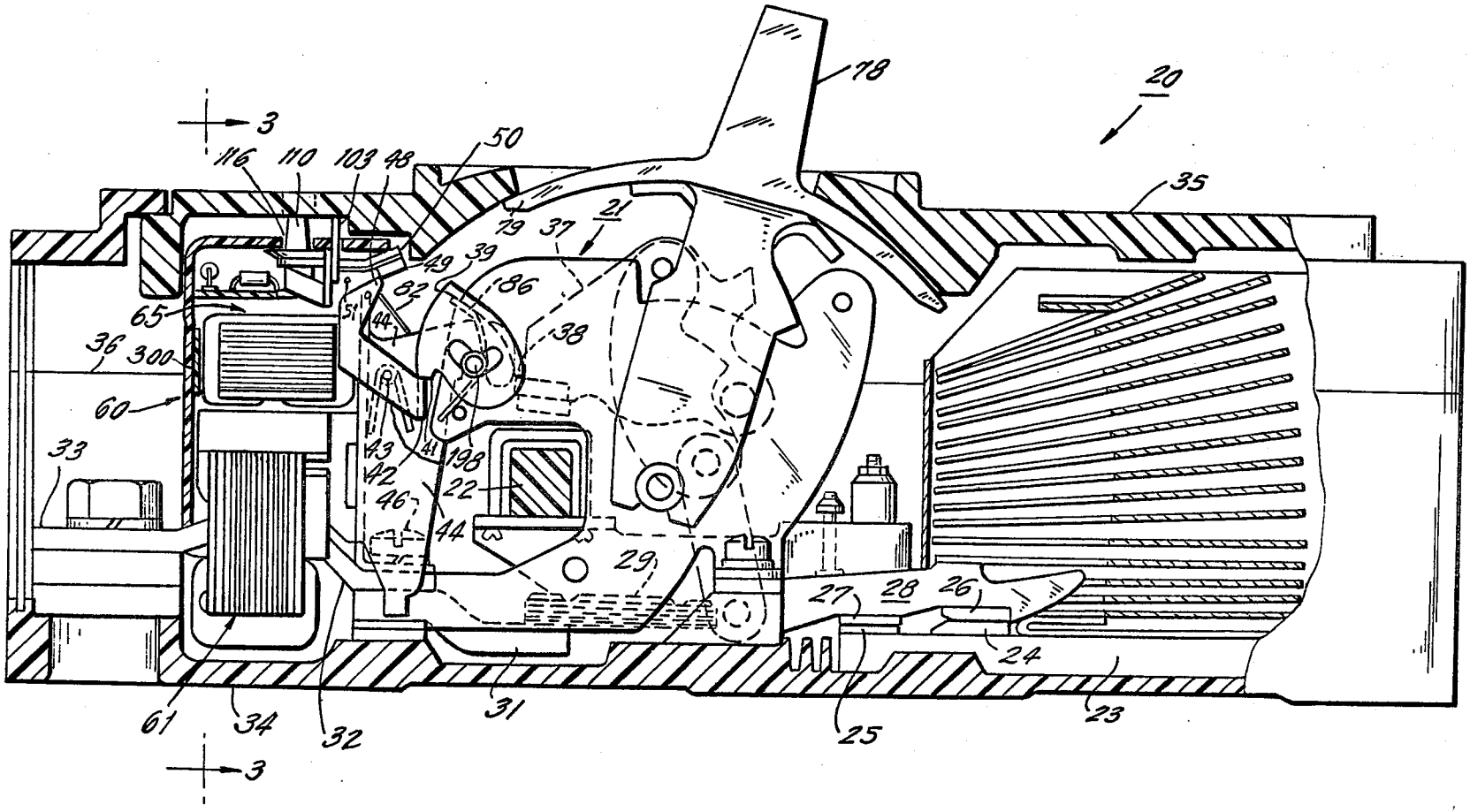
FIG. 1 is a longitudinal cross-section of a multi-pole circuit breaker incorporating a solid state trip means constructed in accordance with the teachings of the instant invention.

Now referring to the Figures. Molded case circuit breaker 20 of FIG. 1 is a three pole unit with a common spring powered contact operating mechanism 21 all disposed within a molded insulating housing consisting of base 34 and cover 35 which is separable from base 34 at line 36. Transverse insulating bar 22 provides a mechanical tie between the movable current carrying elements of all three poles for simultaneous operation thereof in a manner well known to the art.

The current carrying path through the center pole consists of line terminal member 23, stationary arcing and main contacts 24, 25, movable arcing and main contacts 26, 27, movable contact arms 28, flexible conductor 29, strap 31, and main bus section 32 which terminates in load terminal 33. Removable screws 46, extending through clearance apertures 196 in the line ends of buses 32, provides contact pressure between buses 32 and straps 31. The two outer poles of breaker 20 have essentially the same current carrying elements as the center pole just described.

Contact operating mechanism 21 is a conventional trip free spring powered over center toggle unit including releaseable cradle 37 which is normally held in the reset position shown in FIG. 1 by latching portion 38 of auxiliary latch 39. At point 41 auxiliary latch 39 is held by engagement with main latch 42 which is pivotally mounted to support bracket 44 on pin 43. The end of main latch remote from point 41 is provided with nose 48 that is normally engaged by latching plate 49 on trip member 50. The latter is pivotally mounted to bracket 44 on pin 51.

Figure 2:
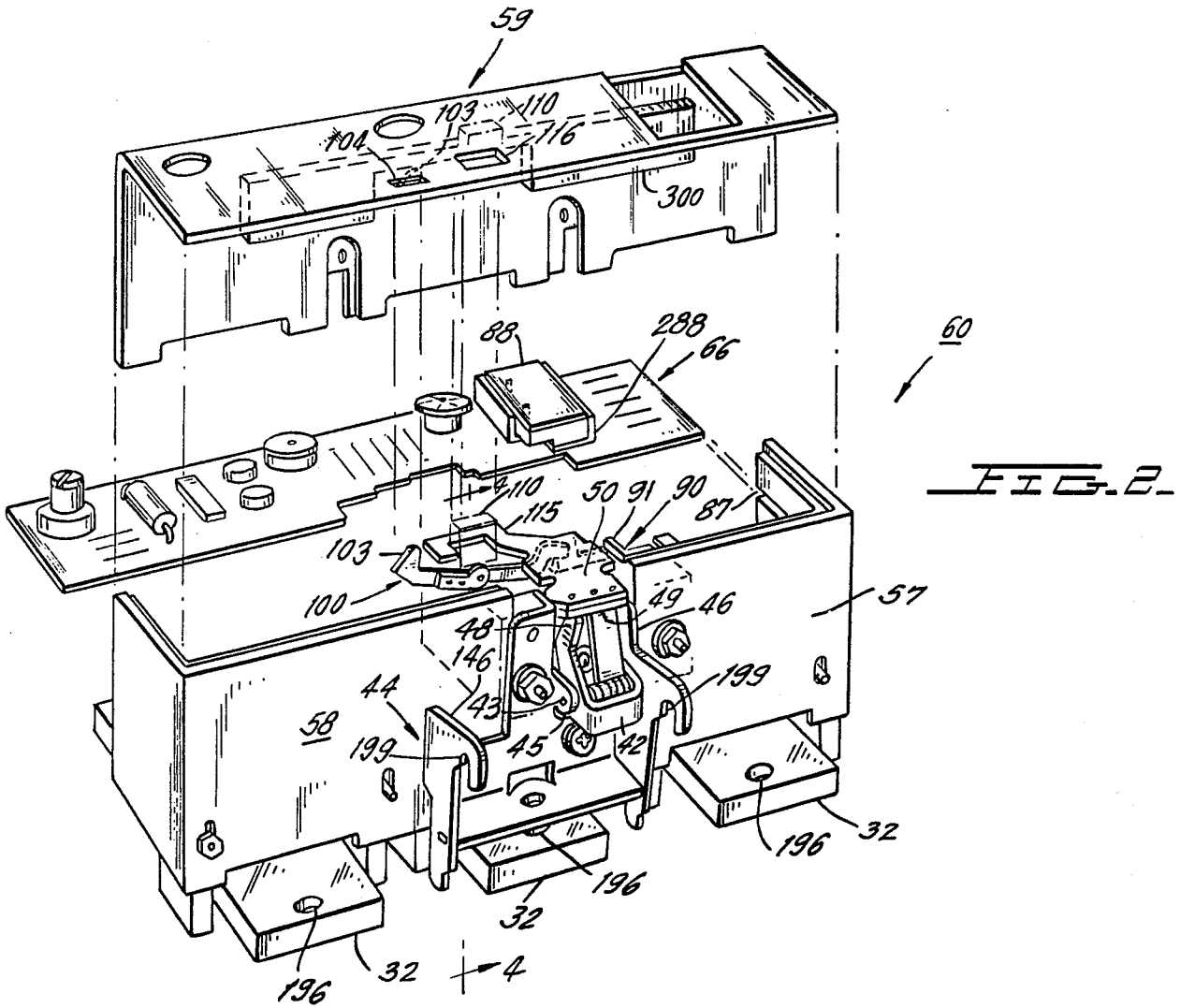
FIG. 2 is an exploded perspective of the solid state trip unit subassembly looking toward the line end thereof.

As explained in detail in the aforesaid application Ser. No. 671,077, bracket 44 and the elements mounted thereto constitute a subassembly which together with all three main buses 32 are elements of removable and replaceable solid state trip unit 60 (FIG.2) disposed within circuit breaker housing 34, 35 at the load end thereof. Unit 60 also includes a common insulating frame or housing consisting of member 58 having a U-shaped cross-section and member 59 having an L-shaped cross-section with the latter constituting a removable cover. The web portion or wall 57 of member 58 extends in a plane generally perpendicular to main conductors 32. The latter are positioned at the bottom of housing 58, 59, when viewed with respect to FIGS. 1–3, and extend beyond both the line and load sides of housing 58, 59. Bracket 44 and the elements mounted thereon constitute a subassembly (FIG. 4) mounted to frame member 58 with the major portion of bracket 44 abutting the line side of wall 57 with pivot 51 for trip member 50 being positioned at the upper end of wall 57.

Each main bus 32 constitutes a single turn primary for an individual input transformer 61 provided for each pole of the circuit breaker 20. Each input transformer 61 also includes square laminated magnetic frame or core through which primary 32 extends. The multi-turn secondary of transformer 61 consists of multi-turn coils 63, 64 wound around opposite legs of core 62 and connected in series aiding relationship. The output of secondary 63, 64 is fed through the multi-turn primary of output transformer 65 whose secondary feeds the solid state control circuitry on circuit board 66. Output transformer 65 is provided with square laminated magnetic frame or core 67 having coil means mounted on opposite legs thereof with each of these coil means consisting of a portion of the primary and a portion of the secondary for output transformer 65. These primary portions are connected in series aiding relationship as are these secondary portions. In total, the secondary of transformer 65 has many more turns than the primary.

Figure 3:
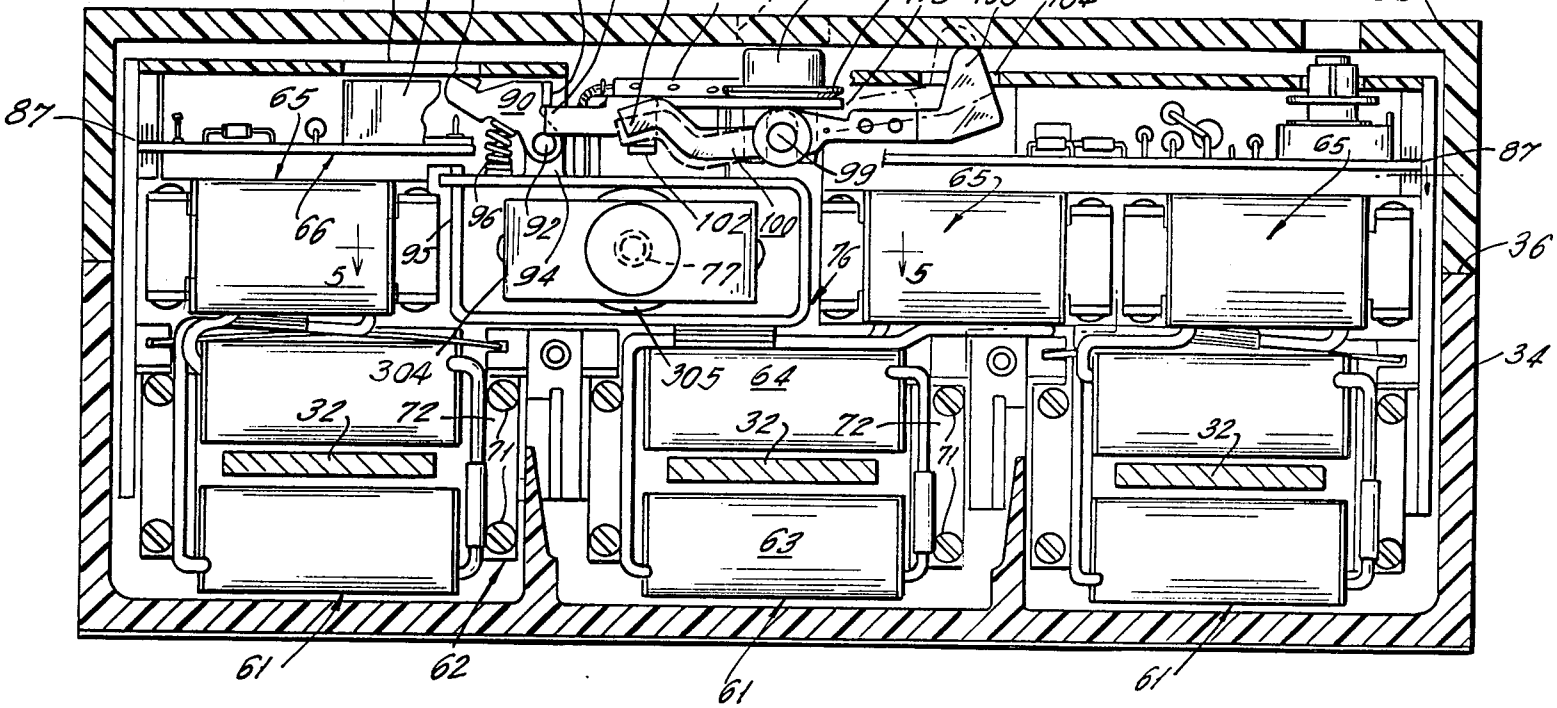
FIG. 3 is a cross-section taken through line 3—3 of FIG. 1 looking in the direction of arrows 3—3.

Cover interlock unit 100 is mounted near its center on pivot 99 and is biased counterclockwise with respect to FIG. 3 by a torsion spring wound about pivot 99 so that end 101 engages projection 102 of trip member 50 to move member 50 counterclockwise with respect to FIG. 1 to its tripping position. The end of member 100 remote from end 101 is provided with upwardly extending nose 103 that projects through clearance slot 104 in cover 59 of trip unit housing 58, 59. As the circuit breaker housing cover 35 is mounted to base 34, the inside surface of cover 35 engages nose 103 to move the latter from the phantom position thereof. This pivots cover interlock 100 clockwise from the phantom to solid line portions of FIG. 3 so that end 101 is raised to a position such that trip member 50 may move clockwise with respect to FIG. 1 to a position wherein latch plate 49 holds latch 42 in latching position. When cover 35, or a removable portion thereof (not shown) aligned with nose 103, is opened, unit 100 pivots clockwise thereby operating trip member 50 counterclockwise with respect to FIG. 1 to release latch 42.

Circuit board 66 includes rating plug 88 that is removably held by friction in socket 288. Rating plug 88 includes one or more of the elements, such as a resistor or capacitor, which determines operation of the electronic processing circuitry of board 66. When operatively positioned in socket 288, plug 88 engages ear 89 of plug interlock or lockout member 90 to pivot same counterclockwise with respect to FIG. 3 about rivet 92 as a center so that latching ear 91 of member 90 moves clear of extension 93 on trip member 50. Rivet 92 extends through ear 94 which projects upward from shield housing 95 of permanent magnet latch 76. Coiled compression spring 96 is interposed between shield 95 and member 90 so that when rating plug 88 is removed member 90 pivots clockwise to a lockout position with ear 91 thereof engaging extension 93 causing trip member 50 to remain in the tripped position to which it had previously been moved by cover interlock unit 100.

It is noted that while the torsion biasing spring for cover interlock 100 is strong enough to trip breaker 20, rating plug interlock spring 96 is not strong enough to trip breaker 20. However, spring 96 is strong enough to hold trip member 50 in tripped position once it has been operated thereto by cover interlock unit 100. Thus, cover interlock 100 is a tripping device while rating plug interlock 90 is a latching device.

Manually operable trip member 110 projects upward through aperture 116 in trip unit housing cover 59. The lower end of member 110 is bifurcated and straddles pin 99 which acts to guide member 110 as it is being depressed. Flange 111 of member 110 is disposed inside of trip unit housing 58, 59 and is supported on trip member extension 115 so that when member 110 is depressed trip member 50 is pivoted counterclockwise about pin 51 with respect to FIG. 1 to release nose 48 of main latch 42 from latch plate 49 thereby tripping operating mechanism 21.

Circuit board 66 is mounted by sliding the short edges thereof in interior grooves 87 (FIG. 2) of frame member 58. As best seen in FIG. 3, all three input transformers 61 are arranged in a horizontal row below circuit board 66. Interposed between circuit board 66 and the row of transformers 61 is another horizontal row containing all three output transformers 65 together with permanent magnet latch unit 76. The latter is described in detail in the G. Gaskill co-pending application Ser. No. 656,108, filed Feb. 9, 1976 for an Improved Magnetic Latch Construction, which issued Oct. 5, 1976, as U.S. Pat. No. 3,984,795 assigned to the assignee of the instant invention.

Figure 5:
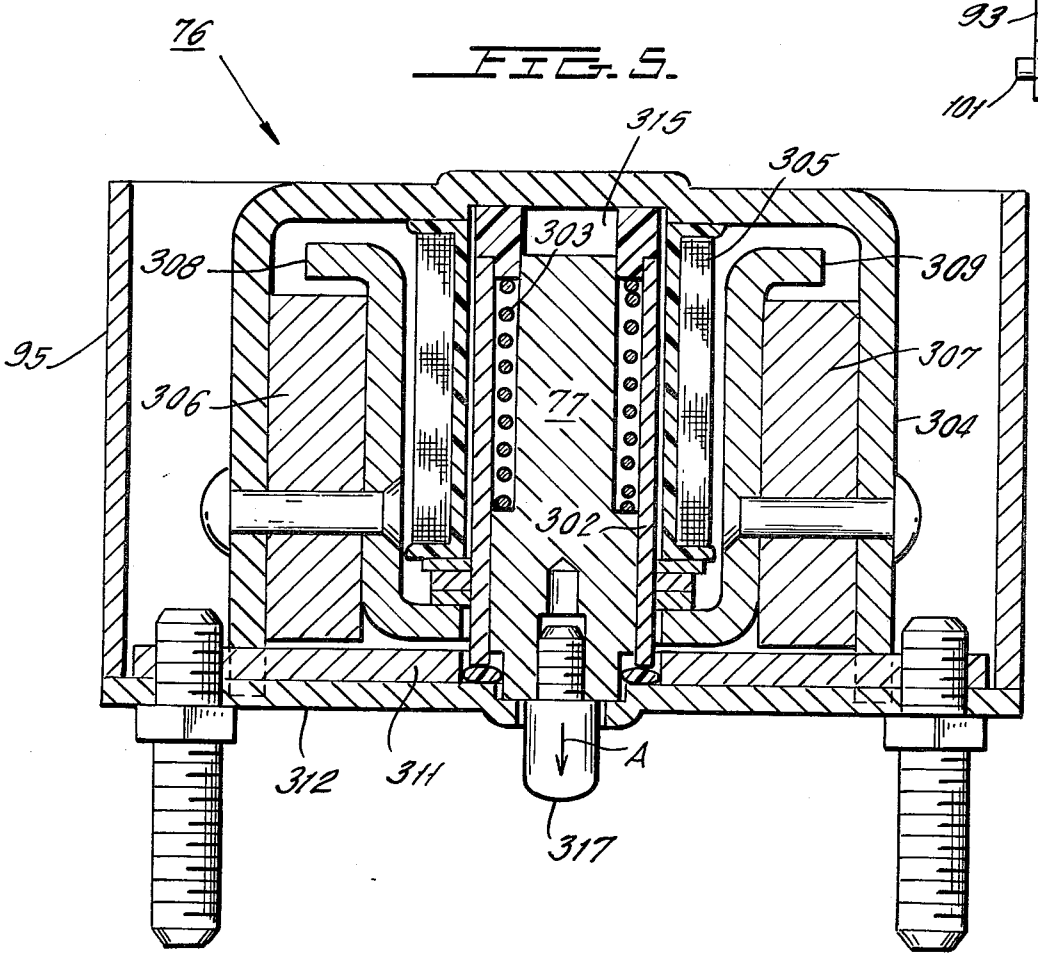
FIG. 5 is an enlarged cross-section of the permanent magnet latch taken through line 5—5 of FIG. 3 looking in the direction of arrows 5—5.

As seen in FIG. 5, permanent magnet latch unit 76 includes magnetic armature 77 mounted within magnetic cylinder 302 and biased by coil compression spring 303 for movement in the tripping direction indicated by arrow A. Cylinder 302 is centered between the legs of U-shaped magnetic frame 304 and is surrounded by the turns of tripping coil 305. A pair of permanent magnets 306, 307 are interposed between the legs of frame 304 and the outside of coil 305. Magnetic diverters 308, 309 are interposed between the respective permanent magnets 306, 307 and coil 305. Frame 304 and the elements disposed between the arms thereof are secured to nonmagnetic plates 311, 312 which are positioned at the free ends of the frame arms, bridging the gap therebetween. Rectangular magnetic shield 95 surrounds frame 304.

In a manner well known to the art, the magnetic flux generated by permanent magnets 306, 307 is insufficient to draw armature 77 in the direction opposite to that indicated by arrow A to close air gap 315. However, after armature 77 is mechanically moved to compress spring 303 and close gap 315, the flux field generated by permanent magnets 306, 307 is strong enough to hold armature 77 in this retracted or latched position. Thereafter, when armature 77 is subjected to sufficient magnetic flux which bucks the magnetic flux generated by permanent magnets 306, 307, the permanent magnet holding force will be overcome by spring 303 which will then move armature 77 to the extended or tripping position shown in FIG. 5 wherein armature nose 317 extends through aligned apertures in plate 311, 312.

Figure 4:
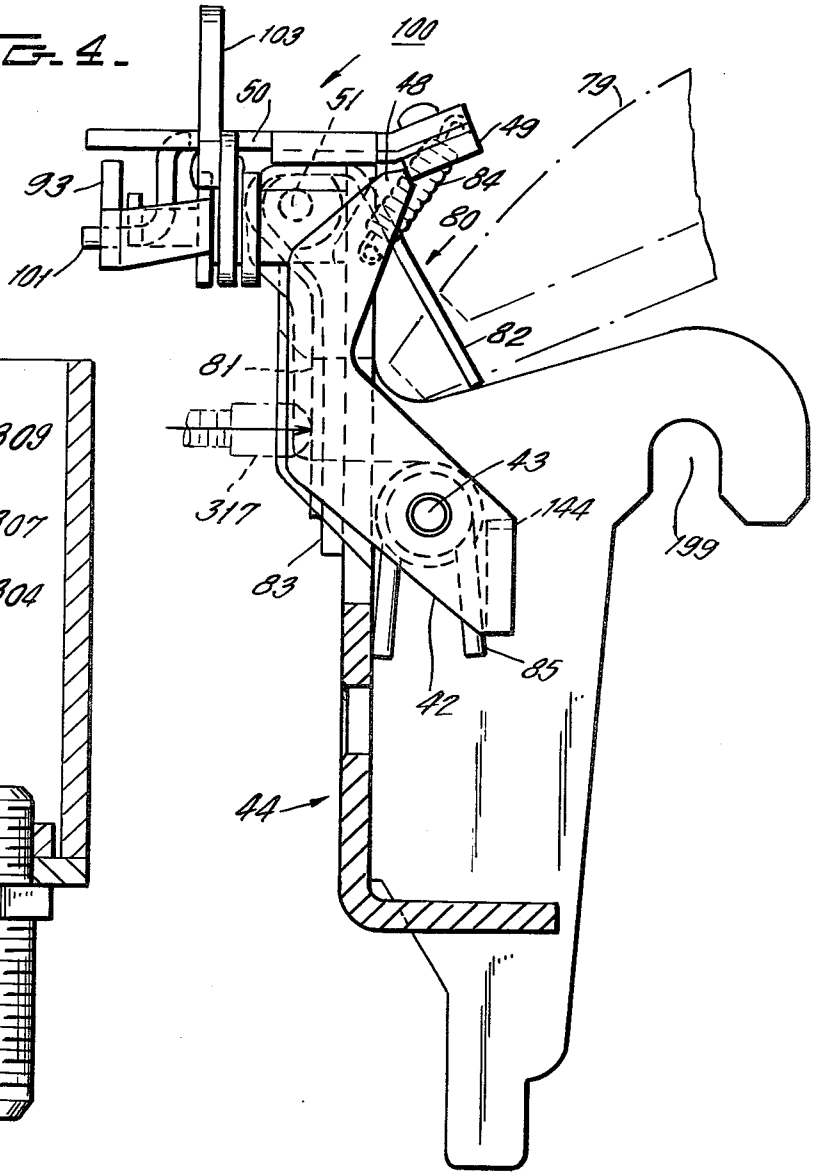
FIG. 4 is an enlarged cross-section of the mechanical latching elements of the subassembly of FIG. 2 taken through line 4—4 of FIG. 2 looking in the direction of arrows 4—4.

As nose 317 moves to its projecting position it engages leg 81 of reset member 80 which in turn engages leg 83 of latch member 50 causing the latter to pivot counterclockwise with respect to FIG. 4 against the force of its return spring 84 thereby releasing engagement between latch plate 49 and nose 48 of latch member 42 to release contact operating mechanism 20. Reset member 80, also mounted on pivot 51, is provided with another leg 82 that is positioned for engagement by extension 79 of circuit breaker operating handle 78. As the latter is moved to the left with respect to FIG. 1 to its reset position, extension 79 pivots reset member 80 clockwise with reset member leg 81 engaging nose 317 to move armature 77 to its retracted or reset position where it is held by the flux field of permanent magnets 306, 307.

Current transformers 61, 65 constantly monitor current conditions in main conductors 32 and, the outputs of transformers 65 are processed by the solid state circuitry of circuit board 66. As explained in detail in the L. Davis and P. Pang co-pending application Ser. No. 658,351, filed Feb. 17, 1976 for a solid state tripping circuit, and assigned to the assignee of the instant invention, when predetermined fault current conditions exist at one or more of the main conductors 32 a control signal is generated to cause energization of bucking coil 305. This releases the energy stored in spring 303 causing nose 317 of armature 77 to be projected and trip circuit breaker contact operating mechanism 21.

In accordance with the instant invention, under extremely severe fault current conditions armature 77 will be released even before a control signal is generated by the solid state circuitry of board 66. This occurs by virtue to magnetic flux generated by current flowing in main conductors 32 being magnetically coupled directly to latch unit 76 in relation to buck the flux field generated by permanent magnets 306, 307. The degree of direct coupling of the main current magnetic flux with the armature holding magnetic circuit elements 304, 306, 307, 308 and 309 is a function of the orientation of these elements with respect to main conductors 32, and is also a function of the degree of magnetic shielding afforded by shield 95.

Since the center pole conductor 32 is closer to latch unit 76 than either of the outer pole main conductors 32, flux generated by current flow in the center pole main conductor 32 should have the greatest influence for direct tripping of latch unit 76. In order to increase the influence of currents in the main conductors 32 of the outer poles, magnetic director plate 300 is provided. The latter is secured to the inner vertical surface of trip unit cover 59 and is shaped to provide a relatively high magnetic permeability path section between conductors 32 and permanent magnet latch 76 for direct coupling of magnetic flux from the former to the latter.

Under most fault current conditions the direct coupling of magnetic flux from current flowing in main conductors 32 to latch unit 76 will not cause tripping of the latter in that the influence of this directly coupled flux will not buck the flux of permanent magnets 306, 307 sufficiently to release armature 77. Under these fault current conditions the solid state circuitry of board 66 must generate a control signal to energize tripping coil 305 for release of armature 77. However, under very severe fault current conditions, even before the solid state circuitry of board 66 has had an opportunity to cause energization of tripping coil 305, flux generated by current flowing in main conductors 32 and by-passing the solid state circuitry of board 66 is magnetically coupled directly to permanent magnet latch 76 to cause release of armature 77 and opening of circuit breaker 20. It should now be apparent to those skilled in the art that the effect of directly coupled flux of main conductors 32 in bucking the flux of permanent magnets 306, 307 to release armature 77 is a function of the construction and location of magnetic shield 95 and/or magnetic director plate 300.

Although there has been described preferred embodiments of this novel invention, many variations and modifications will now become apparent to those skilled in the art. Therefore, this invention is to be limited not by the specific disclosure herein, but only by the appended claims.

What is claimed is:

1. A circuit breaker including cooperating contact means; main conductor means in series with said contact means; an operating mechanism operatively connected to said contact means; a latch means normally maintaining said mechanism latched in position for opening and closing said contact means; first means for monitoring currents flowing in said main conductors means; second means including solid state circuitry for processing signals generated by said first means; third means for releasing said latch means to automatically trip said mechanism thereby opening said contact means responsive to a trip signal generated by said second means when fault currents of predetermined magnitude and character flow in said main conductor means; said third means being operatively constructed and positioned relative to said main conductor means so that as a result of magnetic coupling, magnetic flux generated by severe fault currents flowing in said main conductor means acts directly on said third means for actuating the latter to release said latch means prior to receipt of said trip signal by said latch means; said third means including an operating means, spring means urging said operating means to a trip position for releasing said latch means, permanent magnet means for holding said operating means in a latched position against force exerted by said spring means, and an actuating coil operatively positioned whereby current flowing therein generates a flux which bucks flux of said permanent magnet whereby said permanent magnet releases said operating means when said trip signal is applied to said third means; and magnetic director means operatively positioned to control direct magnetic coupling between said main conductor means and said permanent magnet.

2. A circuit breaker as set forth in claim 1 wherein the third means also includes magnetic shielding means operatively constructed and positioned to control direct magnetic coupling between said main conductor means and said permanent magnet.

3. A circuit breaker as set forth in claim 1 in which the first means includes current transformer means.

4. A circuit breaker as set forth in claim 1 in which the magnetic coupling between the main conductor means and the third means bypasses the second means.

* * * * *